United States Patent [19]

Bagby et al.

[11] 4,158,344

[45] Jun. 19, 1979

[54] ELECTROSTATIC COATING SYSTEM

[75] Inventors: Thomas L. Bagby, Washington; Gary L. Demeny, Delavan; Robert G. Smead, St. Charles, all of Ill.

[73] Assignee: Caterpillar Tractor Co., Peoria, Ill.

[21] Appl. No.: 849,818

[22] Filed: Nov. 9, 1977

[51] Int. Cl.[2] ..... B05B 5/02

[52] U.S. Cl. ..... 118/630; 118/635

[58] Field of Search ..... 118/629, 630, 631, 632, 118/633, 634, 635, 314; 427/33

[56] References Cited

U.S. PATENT DOCUMENTS

| | | | |
|---|---|---|---|
| 2,247,963 | 1/1941 | Ransburg et al. | 118/635 |
| 2,463,422 | 3/1949 | Ransburg et al. | 118/635 X |
| 2,794,416 | 6/1957 | Shepherd | 118/635 X |
| 3,113,037 | 12/1963 | Watanabe | 118/635 X |
| 3,376,156 | 4/1968 | Whitaker et al. | 118/635 X |
| 3,900,000 | 8/1975 | Gallen | 118/630 |

*Primary Examiner*—Mervin Stein

*Attorney, Agent, or Firm*—Wegner, Stellman, McCord, Wiles & Wood

[57] ABSTRACT

An electrostatic coating system in which the workpiece to be coated is charged to a high DC potential. A conveyor moves the workpiece through a coating zone. A separate charge collector disc on the workpiece support passes close to but does not contact a charged conductor. An electrostatic charge is induced on the disc and is transferred to the workpiece. The conveyor is grounded and the workpiece support is connected to the conveyor through a high resistance which completes the charging circuit and drains the charge from the workpiece and support as they leave the coating zone. The ends of the charged conductor are curved away from the path of the charge collector. Insulating plates shield the conductor and limit swinging of the workpiece support.

20 Claims, 5 Drawing Figures

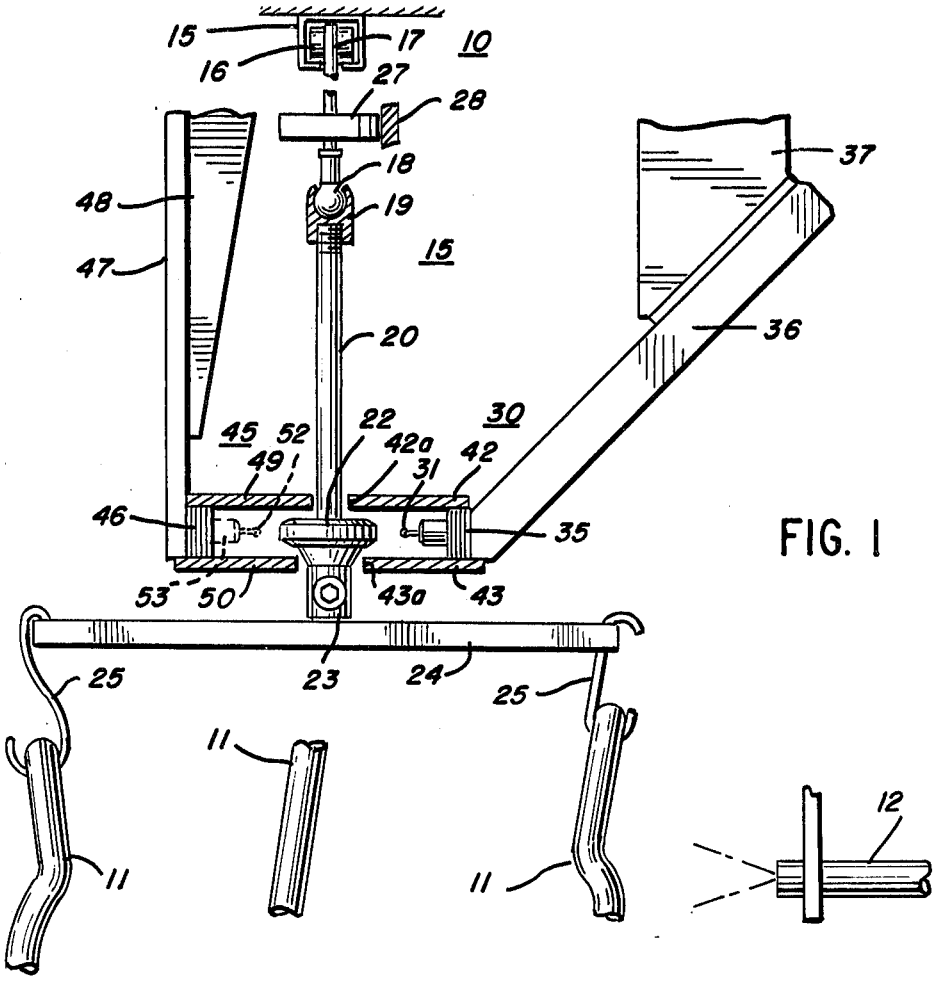
FIG. 1
FIG. 4
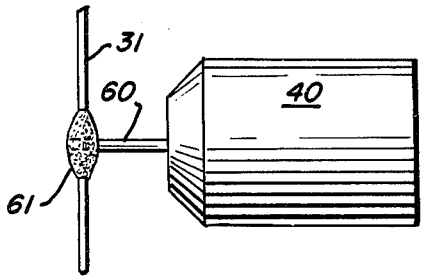
FIG. 5
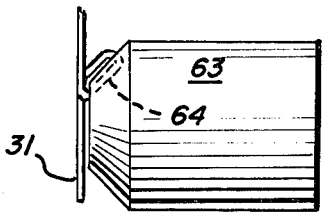

ELECTROSTATIC COATING SYSTEM

BACKGROUND OF THE INVENTION

Electrostatic coating systems in which a charged workpiece is moved by a conveyor through a coating zone have typically had physical contact between the workpiece support and a charged conductor. Such systems are subject to sparking which is undesirable. Systems have been proposed in which an electrostatic charge is induced on a workpiece by moving the support therefor adjacent a charged wire. The support in such systems is free to swing toward and away from the charged wire. This results in a variation of the magnitude of charge on the workpiece, degrading the quality of the coating. Sparking may occur if the support approaches the charged wire too closely.

SUMMARY OF THE INVENTION

The present invention is directed to overcoming one or more of the problems as set forth above.

According to the present invention, an improved means for coupling an electrostatic charge to the workpiece carried on supporting means through a coating zone includes a conductor extending along the path of the supporting means through the coating zone and connected to the source of DC potential. A conductive charge collector is mounted on the supporting means for movement therewith in spaced relation to the charged conductor. A high resistance is connected between the collector and the potential reference so that an electric charge is induced on the collector and is connected with the workpiece.

Further features and advantages of the invention will readily be apparent from the following specification and from the drawings, in which:

FIG. 1 is a section at right angles to the conveyor illustrating the charging system;

FIG. 4 is an enlarged detail of a wire mounting insulator; and

FIG. 5 is an enlarged detail of a modified insulator.

Figure 2:
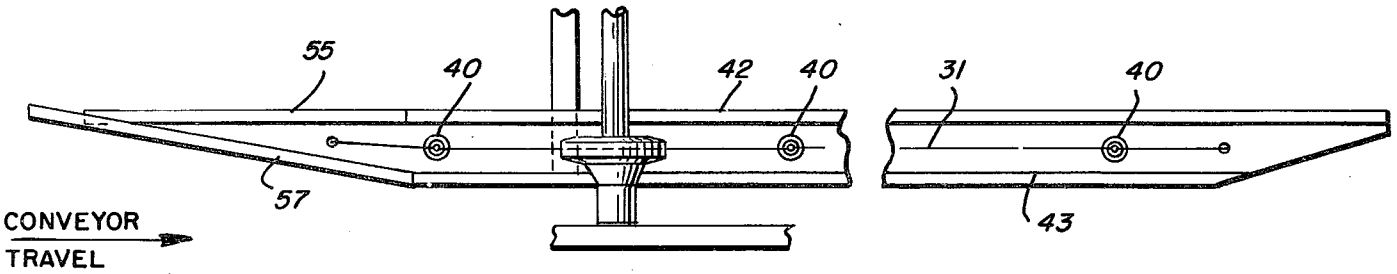
FIG. 2 is an elevation of the charged wire and the insulating framework on which it is mounted.

The invention is illustrated in an article-coating system having an overhead conveyor 10 which moves workpieces 11 through a coating zone adjacent one or more paint spray guns 12. Further details of a coating system with which the invention may be utilized are disclosed in Bagby et al United States patent application Ser. No. 678,844, filed Apr. 21, 1976.

The overhead conveyor 10 has a track 14 mounted on a suitable overhead support and electrically connected with a potential reference, as ground. A workpiece support 15 includes a wheeled carrier 16 which moves along the track and may be drawn by a chain (not shown). A depending support rod 17 is mounted for rotation in carrier 16 and has at its lower end the male or ball member 18 of a swivel joint. The female member 19 of the swivel joint carries a depending rod 20 of high resistance material. At the lower end of rod 20 is a circular charge collector disc 22 of conductive material. A collar 23 connects a workpiece supporting rack 24 with rod 20 and charge collector 22. Workpieces 11 are hung from the rack 24 by hooks 25. Collar 23 allows limited tilting of rack 24 relative to rod 20 (as 5° to 10° from the horizontal position) to accommodate unsymmetrical loads.

The workpiece support is preferably rotated as it moves through the coating zone for uniform exposure of workpieces to the coating material. A drive wheel 27 on support rod 17 engages drive surface 28 causing the entire supporting assembly to rotate as the carrier 16 moves along track 14. Ball joint 18, 19 has interengaging surfaces which transmit rotation from support rod 17 to support rod 20 yet permit swiveling movement between the rod 17, 20 so that rack 24 is free to swing or to tilt with an unbalanced load.

Figure 3:
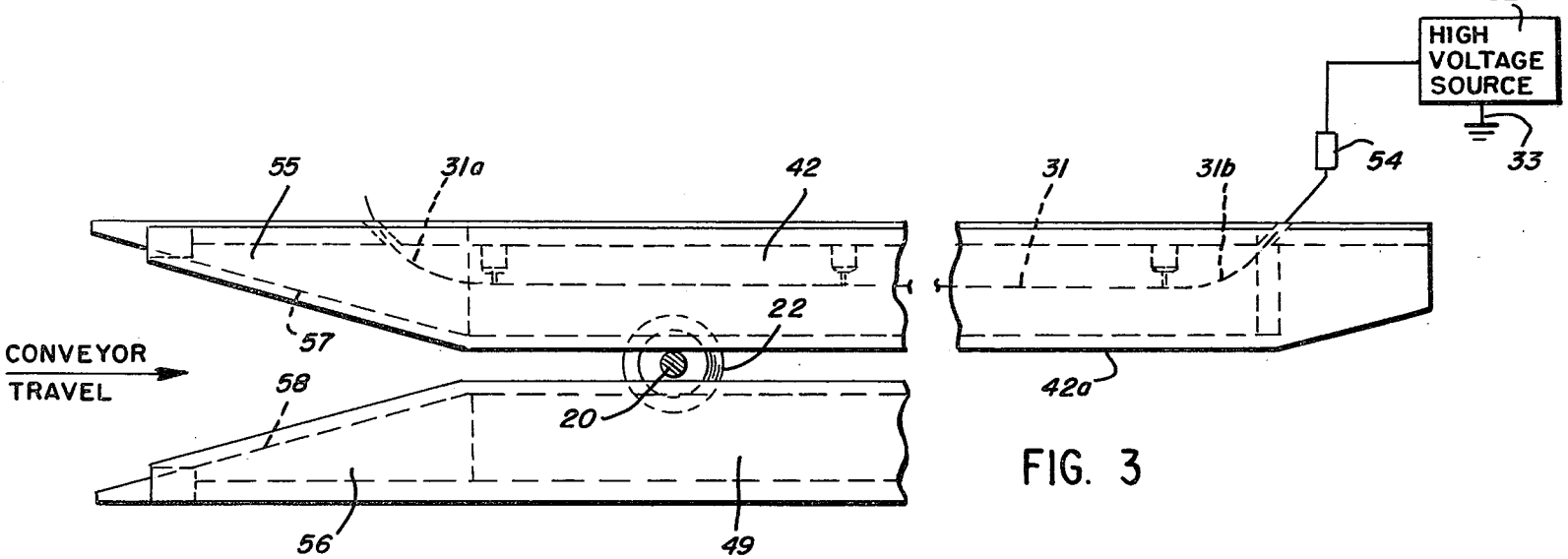
FIG. 3 is a broken plan view of the insulating framework on which the charged wire is mounted.

A framework 30 of insulating material extends along one side of the conveyor, through the coating zone as best seen in FIGS. 1 and 3. A wire 31 is mounted on the framework and is connected with a suitable high voltage source 32 returned to ground potential, indicated at 33. Framework 30 has a back plate 35 carried from insulating hangers 36, 37 suspended from a suitable overhead support (not shown). A plurality of mounting insulators 40 are spaced along the length of back plate 35 and carry the charged wire 31, as will appear. Upper and lower plates 42, 43 respectively provide a shield for wire 31. The edges **42*a*, 43*a* of plates 42, 43 are positioned to limit swinging movement of support rod 20 and charge collector 22 toward charged wire 31. The minimum distance is selected so that sparking does not occur at the voltage of source 32** and is preferably twice the sparking distance.

As the workpiece support approaches the coating zone, charge collector 22 enters the field established by the high voltage on wire 31. A current flows across the gap between wire 31 and collector 22, through resistance rod 20 and conveyor 15 to ground. A substantial portion of the voltage on wire 31 is induced on charge collector 22 and connected through rack 24 with workpiece 11. For example, with 100 KV on wire 31, a spacing of 50 mm between the wire and collector and a resistance of $10^3$ megohms, a voltage of 68 KV is induced on the workpieces. The sparkover distance is 33 mm. When the collector 22 leaves the field around wire 31, the charge on the support and workpiece is dissipated through resistance rod 20.

Charge collector disc 22 has an edge facing the charged wire with a dimension many times the wire diameter. Th corners between the upper and lower faces of the disc and the edge are rounded or beveled so that high electrostatic field gradients and corona discharge are avoided.

The end sections **31*a*, 31*b*** of the charged wire at the entrance and exit of the coating zone are curved away from the path of the conveyor, to minimize high field gradients. As the grounded workpiece support and charge collector approach the coating zone, the distance between the charged wire and the charge collector gradually diminishes and the charge induced on the collector gradually builds up. Sparking which might occur if the workpiece supports were introduced rapidly into the field of the charged wire is avoided.

Preferably, a second framework 45 of insulating material extends along the path of the conveyor through the coating zone parallel to and facing the framework 30. Framework 45 has a back plate 46 carried from hangers 47, 48. Upper and lower insulating plates 49, 50, respectively, are secured to back plate 46. The edges of plates 49, 50 facing plates 42, 43, are spaced therefrom to limit the swing of supporting rod 20 and charge collector disc 22 away from charged wire 31. Sparking is avoided and the maximum and minimum induced voltages are established by the geometry of frameworks 30, 45.

The voltage on workpieces 11 may further be stabilized by providing a second charged conductor 52 mounted on insulators 53 carried by back plate 46. With collector 22 between two charged conductors, swaying motion which changes the spacing from one conductor results in an equal and opposite change in spacing from the other charged conductor. There is little or no change in the charge induced on the collector.

Charged wires 31, 52 are preferably small in diameter to minimize the electrical capacity of the charged system, thus minimizing the high voltage electrical energy available in the event a spark should occur. A 0.13 mm stainless steel wire has been found satisfactory. A resistor 54 connected between the high voltage source 32 and charged wire 31 isolates the charged wire from the capacity of source and the connecting cable minimizing the energy available in the event a spark occurs.

The geometric relation of the facing surfaces of the charged conductor and the charge collector is important. Preferably the wire is small and the collector large, as shown. Alternatively, the charged conductor could have a wire surface facing the conveyor and the charge collector may have a knife edge.

In a specific embodiment of the coating system, collector disc 22 has a diameter of 100 mm and a thickness of 25 mm. The radius of curvature of wire end sections 31*a*, 31*b* is 150 mm.

The supporting structure and workpieces carried by an overhead conveyor are subject to substantial swinging, particularly if the conveyor moves rapidly and has sharp turns. The entry end of frameworks 30, 45 (at the left in FIGS. 2 and 3) are provided with insulating plates which converge toward the center of the conveyor path to restrain or limit swinging before the support and articles enter the coating zone. Insulating plates 55, 56 extend from the ends of upper plates 42, 49, respectively, and have facing edges which converge toward the center of the path through the coating zone. Plates 57, 58 extend from lower plates 43, 50, respectively, and are inclined downwardly in the direction of conveyor travel and inwardly toward the center of the conveyor path. A swinging conveyor is restrained by one or more of plates 55, 56, 57, 58 as it enters the coating zone.

FIG. 4 illustrates a T-connector mounting for wire 31. Insulator 40 has a pin 60 extending from the end thereof. The wire 31 passes through an eye at the extremity of the pin and is secured with solder 61 shaped to avoid sharp corners and points.

A preferred mounting is shown in FIG. 5. Insulator 63 has a hole 64 extending therethrough from the end face to the side wall. Wire 31 is threaded through the hole 64 and wrapped across the end face of the insulator.

The embodiments of the invention in which an exclusive property or privilege is claimed are defined as follows:

1. In a coating system having a conveyor with a supporting means for moving a workpiece through a coating zone, improved means for directing an electrostatic charge to a workpiece carried on said supporting means, comprising:

a conductor extending along the path of said supporting means through said coating zone;

a source of DC potential connected with said conductor to charge it at a high potential with respect to a potential reference;

a conductive charge collector operatively associated with said supporting means, for movement with the supporting means along and in spaced relation to said charged conductor through the electric field associated therewith, one of said conductor and said charge collector having a wide surface and the other having a narrow surface, the wide surface having a generally arcuate convex configuration presented to the narrow surface, both surfaces being free of sharp points, said surfaces being juxtaposed for current flow therebetween;

a high resistance connected between the collector and said potential reference, whereby an electric charge is induced on said collector by said field; and means electrically connecting said collector with the workpiece in load supporting relation to impart the induced electric charge thereto.

2. The coating system of claim 1 including means extending the length of the conductor through the coating zone to limit movement of said charge collector toward said conductor.

3. The coating system of claim 1 including means extending the length of the conductor through the coating zone to limit movement of said charge collector away from said conductor.

4. The coating system of claim 1 wherein the charge collector is a disc, and including a second conductor extending along the path of said supporting means through said coating zone and spaced from the first conductor with the work supporting means and charge collector between the conductors so that swinging of the supporting means moves the charge collector toward one of the conductors and away from the other conductor.

5. The coating system of claim 4 including means for limiting movement of said charge collector toward and away from each of said conductors.

6. The coating system of claim 1 in which said conductor is a small wire and said charge collector is a circular disc with an edge which is many times wider than the width of said conductor and with corners between its upper and lower faces and said edge which are rounded.

7. The coating system of claim 1 including means for rotating the workpiece supporting means as it passes through the coating zone, and in which said charge collector is a circular disc so that the spacing between the disc and the charged conductor is relatively constant as said supporting means rotates.

8. The coating system of claim 1 in which said charged conductor is a wire and the collector surface presented to the wire is wider than the wire in its dimension at right angles to the length of the wire and has said arcuate convex configuration in its dimension along the length of the wire.

9. The coating system of claim 8 in which said wire has a diameter of the order of 0.13 mm.

10. The coating system of claim 8 in which said wire conductor is mounted from a plurality of insulators spaced along the coating zone.

11. The coating system of claim 10 in which each insulator has a metal pin mounted therein the pin having an eye at the extremity thereof, the wire extending through the eyes of the pins on said insulators and being secured in each eye by solder.

12. The coating system of claim 10 in which each insulator has a hole therethrough extending from an end face to a side wall, said wire being threaded through the hole in each of the insulators and lying across the end faces thereof.

13. The coating system of claim 1 in which said supporting means is suspended from an overhead conveyor and including means for limiting the swinging of the supporting means as it enters the coating zone, comprising a pair of converging barriers extending downwardly and toward each other in the direction of movement of the supporting means for engagement by a swinging supporting means as it enters the coating zone.

14. The coating system of claim 6 having a pair of spaced plates of insulating material, one above and the other below said conductor to shield the conductor and limit movement of the supporting means and collector disc toward the conductor, said disc extending between said plates with its edge facing said conductor.

15. In an electrostatic coating system, improved means for coupling an electrostatic charge to a workpiece, comprising:

an overhead conveyor;

a support hanging downwardly from said overhead conveyor to move a workpiece through a coating zone;

means engaging the said support to cause rotation thereof;

a swivel joint in said support below said rotation causing means to accommodate swinging of said workpiece;

an insulating frame in the coating zone;

a conductor carried by said frame, and extending adjacent the path of the conveyor through said coating zone;

a source of DC potential connected with said conductor to charge it at a high potential with respect to a potential reference;

a charge collector with a circular periphery on said support, for movement with the support along and in spaced relation to said charged conductor through the electric field associated therewith;

a high resistance connected in the support between the charge collector and the conveyor, whereby an electric charge is induced on said collector by the field associated with the charged conductor;

a plate of insulating material extending along the length of said conductor to limit movement of the charge collector and support toward the conductor; and a second plate of insulating material adjacent the path of the support approaching the coating zone to limit the swing of the support before the collector enters the field of the charged conductor.

16. The electrostatic coating system of claim 15 in which said last mentioned insulating plate is inclined downwardly and toward the center of the nominal path of the support to join with said first plate to limit the swing of the collector as it enters the field of said conductor.

17. The electrostatic coating system of claim 15 having a frame with a second conductor connected with said source of DC potential, extending along the path of the conveyor through the coating zone, generally parallel with the first conductor and on the opposite side of said charge collector therefrom; and insulating plate extending along the length of the second conductor to limit movement of the collector toward the second conductor; and a further insulating plate adjacent the path of a support approaching the coating zone for limiting the swing of the support before the collector enters the electrostatic field of the conductors.

18. The coating system of claim 17 in which said two swing limiting insulating plates converge toward the center of the support path and are inclined downwardly along the path, stabilizing the position of the support as the collector enters the electrostatic field.

19. The electrostatic coating system of claim 15 having two insulating plates extending along the length of the conductor, one above and the other below the conductor to shield the conductor.

20. The coating system of claim 1 in which the end section of said charged conductor at the entrance of said coating zone is curved away from the path of said charge collector.

* * * * *